United States Patent [19]

Kies et al.

[11] Patent Number: 4,921,217

[45] Date of Patent: May 1, 1990

[54] GROUND RODS AND APPARATUS FOR FORMING AND PLACING SUCH RODS

[75] Inventors: Anton M. Kies, KA Oisterwijk; Harry C. van den Nieuwelaar, AD Gilze, both of Netherlands

[73] Assignee: Erico International Corporation, Solon, Ohio

[21] Appl. No.: 107,798

[22] Filed: Oct. 19, 1987

Related U.S. Application Data

[63] Continuation-in-part of Ser. No. 925,225, Oct. 31, 1982, abandoned.

[51] Int. Cl.[5] ..... E21B 19/22

[52] U.S. Cl. ..... 254/29 R

[58] Field of Search ..... 254/30, 31, 132, 29 R; 173/122, 123, 28, 116; 166/77, 384, 385, 177, 54.5; 405/154, 184; 269/221

[56] References Cited

U.S. PATENT DOCUMENTS

| | | | |
|---|---|---|---|
| 2,624,177 | 1/1953 | Warren | 173/116 |
| 2,871,896 | 2/1959 | Markwell | 269/221 |
| 3,088,385 | 5/1963 | Dorkins et al. | 173/122 |
| 3,329,401 | 7/1967 | Becker et al. | 254/29 R |
| 3,613,804 | 10/1971 | Johsson | 254/29 R |
| 3,690,136 | 9/1972 | Slator et al. | 166/77 |
| 3,871,617 | 3/1975 | Majima | 173/123 |
| 4,249,600 | 2/1981 | Bailey | 254/29 R |
| 4,417,624 | 11/1983 | Gockel | 166/77 |
| 4,555,090 | 11/1985 | Averhoff | 254/29 R |
| 4,660,635 | 4/1987 | Wittrisch | 166/54.5 |

*Primary Examiner*—Robert C. Watson

*Attorney, Agent, or Firm*—Renner, Otto, Boiselle & Sklar

[57] ABSTRACT

This invention relates generally as indicated to ground rods, and more particularly to one piece ground rods of substantial length, and a method and apparatus for forming and placing such rods. Ground rods are normally steel rods having a copper cladding.

26 Claims, 5 Drawing Sheets

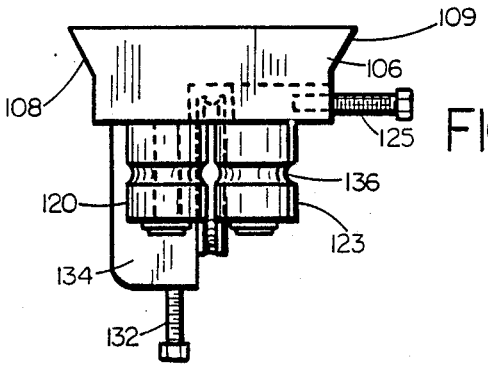
FIG.5
FIG.3
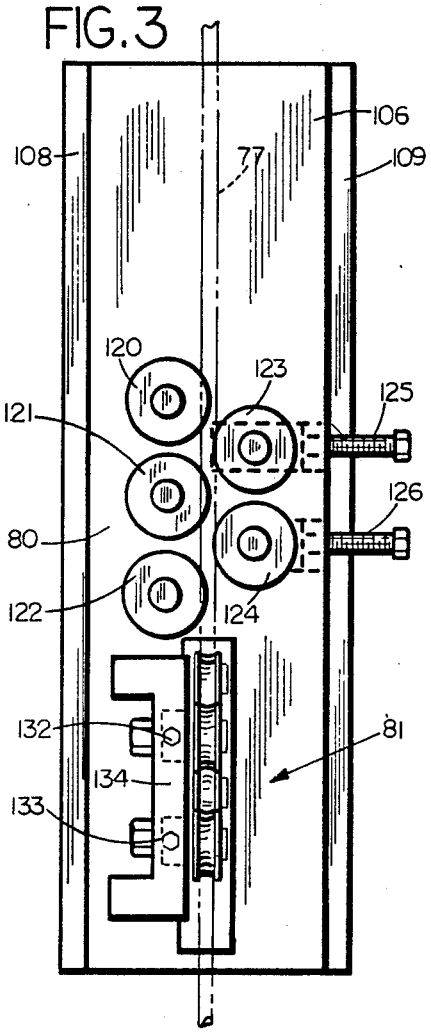
FIG.4
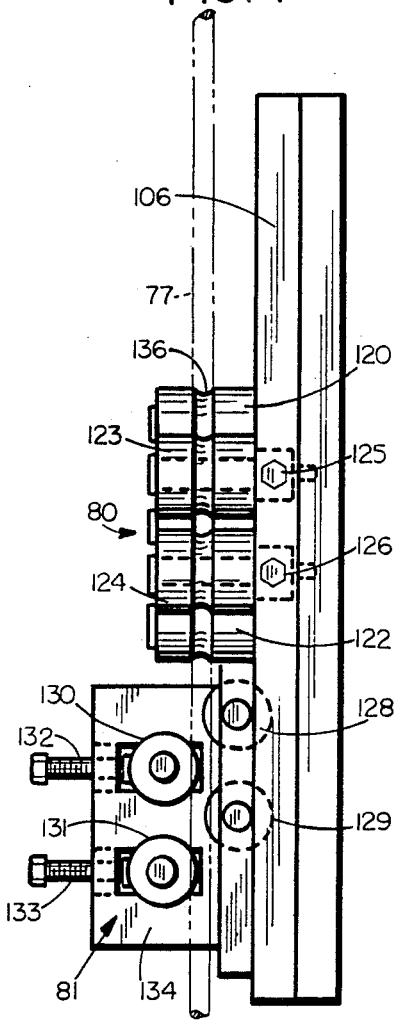

GROUND RODS AND APPARATUS FOR FORMING AND PLACING SUCH RODS

RELATED APPLICATION

This application is a continuation-in-part of application Ser. No. 925,225 filed Oct. 31, 1986, now abandoned, entitled "Ground Rods and Method and Apparatus for Forming and Placing Such Rods".

BACKGROUND OF THE INVENTION

They are normally formed in discrete relatively short lengths or sections such as about 3 meters and are driven into the ground by pounding. The lengths are coupled one to another as the driving progresses. Such couplings are relatively expensive and must not only be able to transmit the driving force but also provide a good electrical connection. If buckling occurs it is usually at a coupling. The coupling process at the site of installation is difficult and troublesome. The pounding process is also difficult since the coupling must be made close to the ground while the pounding or driving process then starts over again at the top of the next section. Moreover, when threaded connections are used the pounding process may damage the ends of the rod sections. The installer then has a choice; which is, make a bad connection, or start over. Such problems are exacerbated by the malleability of the copper cladding which is easily marred or damaged. Moreover, such couplings are the usual source of corrosion or failure over the expected life of the ground rod after installation.

Examples of ground rods and couplings therefor may be seen in the following U.S. patents: U.S. Pat. No. 4,577,053; U.S. Pat. No. 3,716,649; Canadian Patent No. 473,618; and U.S. Pat. No. 2,186,482.

Accordingly it would be highly desirable to have a one piece ground rod which could be formed and placed directly from a large or an extended length or coil of copper clad steel rod. The handling and placement of extremely long straight sections presents a formidable transportation and placement problem and would require massive, unwieldly and very expensive equipment. This is because ground rods are oftentimes driven to significant depths. Such depths may exceed the length of a football field.

It is accordingly also desirable that the ground rod be formed in a readily transportable package such as a coil and that the placement apparatus also be portable. It is further desirable that the placement apparatus be capable of driving either coiled continuous rod or straight rod sections, and be able to pull the rod from the ground.

SUMMARY OF THE INVENTION

A one piece ground rod of substantial length is placed in the ground with the apparatus and method of the present invention. The apparatus includes a coiled supply of such rod which is fed from such coiled supply downwardly through a driver which includes two sets of straightener rolls, and into a vertically movable gripping jaw. The jaw is mounted on a slide movable axially of the rod. The jaw and the slide are hydraulically operated. When the jaw is closed, the slide is driven downwardly to move the ground rod through a bottom guide into the earth. At the end of the stroke of the slide, the jaw is opened and the slide retracted. When the jaw is again closed the slide is again extended driving the rod into the earth. The action of the slide incrementally draws the rod from the coiled supply, through the straightening rolls and drives it into the earth to the desired depth. If the driving resistance increases above a certain level, a vibration system providing high frequency impacts automatically comes into operation. The vibration system may be applied mechanically or hydraulically. In some embodiments the hydraulic driving cylinder is mounted for limited movement which brings into play the vibration system. In other embodiments the vibration system may be actuated in response to pressure in the hydraulic system. The mechanical vibration system utilizes a rotary stepped ring, while the hydraulic system may use an auxiliary pulse creating pump, or rotary or shuttle valves in the system. At such desired depth the rod is cut off and a suitable connection made. The coiled supply and the driver may be mounted on a vehicle with the driver hinged at the back of the vehicle for quick positioning and set up to the desired position and location.

The angle of the rod driven into the ground may readily be controlled and the driver, when not in use, may be positioned automatically on the vehicle for transportation with the rod supply. A counter measures the depth of the rod being driven. The end of the rod may be placed to project slightly from the ground or be positioned slightly below the surface. The rod may also be pulled from the ground by simply reversing the operation of the driver. The driving may be accomplished in a fully automatic fashion and the driver may be powered from the hydraulic system of the vehicle.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 3 is an enlarged elevation of the straightener as seen from the same plane as FIG. 2;

FIG. 4 is a side elevation of the straightener as seen from the right hand side of FIG. 3;

FIG. 5 is a top plan view of the straightener;

DETAILED DESCRIPTION OF THE PREFERRED EMBODIMENTS

Figure 1:
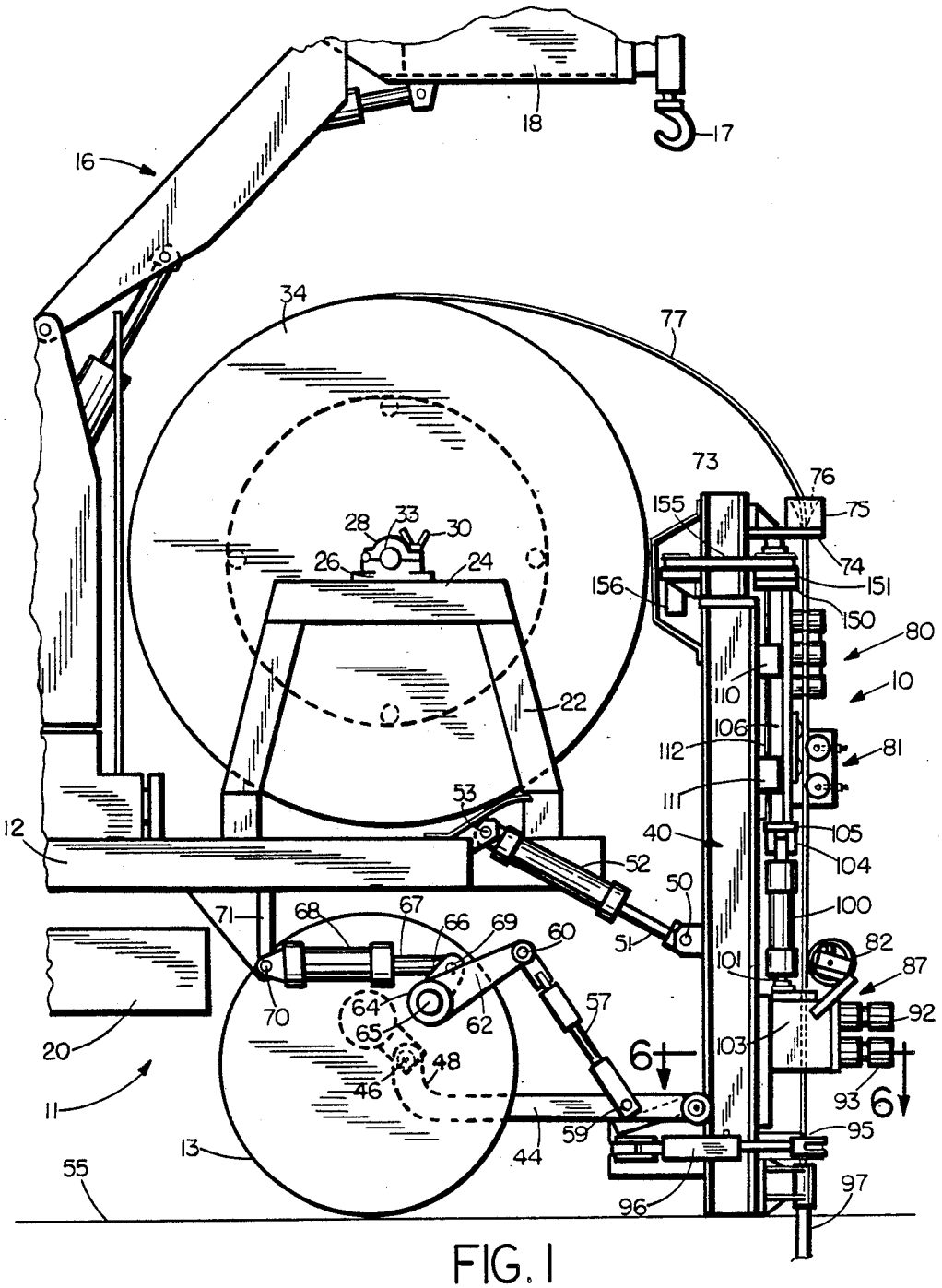
FIG. 1 is a fragmentary side elevation of a ground rod driver and rod supply in accordance with the present invention in operative position on the back of a vehicle.
Figure 2:
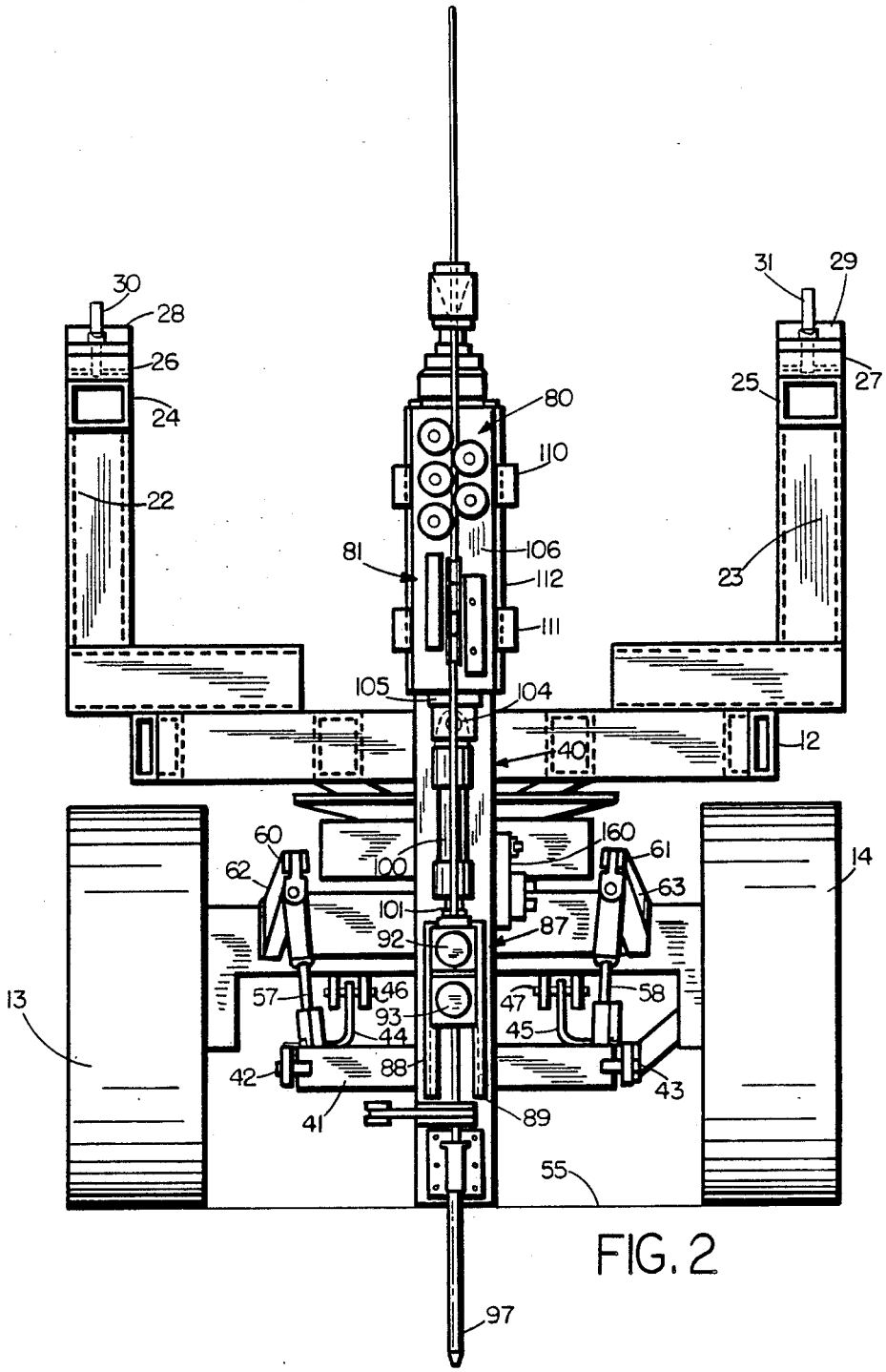
FIG. 2 is a partial end elevation of the back of the vehicle as seen from the right hand side of FIG. 1.

Referring first to FIGS. 1 and 2 there is illustrated generally a ground rod driver 10 in accordance with the present invention which is mounted on the back of a truck or other vehicle shown generally at 11. The truck includes a bed 12 supported on rear wheels 13 and 14. Mounted on the bed of the truck is a hydraulic crane shown generally at 16. The hook 17 of the crane on the end of the boom 18 may be positioned over the end of the truck. The crane is hydraulically operated from hydraulic supply unit shown generally at 20 which includes, in conventional fashion, a hydraulic pump driven by the engine of the truck. The hydraulic supply unit also drives the ground rod driver 10 as well as piston-cylinder assemblies hereinafter described which facilitate the placement of the ground rod driver in the proper upright or angled position at the rear of the truck bed.

Also mounted on the truck bed are two upstanding supports or frames shown generally at 22 and 23 which include horizontal top frame members 24 and 25, respectively. Centered on such horizontal frame members are saddle blocks 26 and 27 which cooperate with hinged blocks 28 and 29 which are readily locked in closed position by wing nut fasteners 30 and 31. The hinge and saddle blocks are provided with mating half round surfaces which in the closed position receive the axle 33 of a spool 34 containing a coiled supply of ground rod. In this manner the coil of ground rod at the rear of the truck, thus supported, is free to rotate about its horizontal axis.

The driver 10 comprises an elongated frame 40 which at the rear lower end thereof is provided with a transverse strut 41 which is pivoted at 42 and 43 to links 44 and 45. The opposite ends of the links are pivoted at 46 and 47 to the rear axle housing of the truck by the clevis connections illustrated. As illustrated the links may be spread at their outer ends and offset upwardly at their inner ends as indicated at 48.

Positioned above the horizontal strut 41 is a clevis pivot connection 50 for the rod 51 of a piston-cylinder assembly 52, the cylinder of which is pivoted at 53 to the truck bed 12. By extending the piston-cylinder assembly 52 the angular position of the frame 40 may be changed so as to control the angle at which the ground rod is driven into the ground indicated at 55.

In order to position the frame 40 at the back of the truck for driving a ground rod there is provided a pair of adjustable links 57 and 58 pivoted at 59 to the respective links 44 and 45 and also pivoted at 60 and 61 to crank arms 62 and 63, respectively. The crank arms are secured to horizontal tube 64 pivoted on fixed shaft 65. A shorter crank arm 66 is provided in the middle of the tube to which a rod 67 of piston-cylinder assembly 68 is pivotally connected as indicated at 69. The blind end of the piston-cylinder assembly is pivotally connected at 70 to bracket 71 secured to the truck bed. Accordingly, extension of the piston-cylinder assembly 68 will cause the frame 40 to move from a transport position to the vertical or driving position shown, the angle of which may be controlled by the piston-cylinder assembly 52.

The top of the frame 40 includes a somewhat narrower extension 73 to the face of which is secured a bracket 74 on top of which is a rod guide 75. The guide 75 includes a conical guide aperture 76 to facilitate the threading of the leading end of the rod 77 from the spool 34.

From the guide 75 the rod 77 passes downwardly through sets of straightener rolls indicated generally at 80 and 81. The straightener rolls are shown in more detail in FIGS. 3, 4 and 5.

From the straightener rolls the rod passes a rotary counter 84 and into the jaws 85 and 86 of vertically movable hydraulic vice assembly 87. The hydraulic vice is shown in more detail in FIG. 6. The hydraulic vice is mounted for vertical sliding movement in gibs 88 and 89 mounted on the face of the frame 40. As indicated, the vice includes the fixed jaw 85 and a movable vertically coextensive jaw 86 which is opened and closed by hydraulic piston-cylinder assemblies 92 and 93. From the jaws the rod passes through a hydraulic shear 95 which is actuated by piston-cylinder assembly 96 and into the top of a relatively short guide tube 97 which projects a short distance into the ground 55. Guide tube 97 may be removably mounted on short horizontal frame extension 98 secured to the bottom of the frame 40.

In order to move the jaw assembly 87 vertically there is provided a piston-cylinder assembly 100, the rod 101 of which is connected to the top of the housing 103 of the vice assembly. The blind end of the piston-cylinder assembly 100 is pivoted through the clevis connection 104 mounted on plate 105 secured to the bottom end of mounting plate 106 for the roll straighteners 80 and 81.

As illustrated more clearly in FIGS. 3–5, the plate 106 is provided with angled edges 108 and 109 which are retained by gibs seen at 110 and 111. Such gibs project from face plate 112 secured to the front of the frame 40. Plate 105 at the bottom of the roll plate 106 projects beneath the face plate 112 so that the blind end of the piston-cylinder assembly 100 cannot move or back-off beyond the abutment between the plate 105 and the bottom of the face plate 112.

Referring now to FIGS. 3–5 it will be seen that the straightening roll sets 80 and 81 are arranged to straighten the rod in two different planes. The roll set 80 straightens the rod in a plane parallel to the axis of the coil or spool while the roll set 81 straightens the rod in a plane normal to the axis of the roll or spool. Depending upon the manner in which the rod is coiled, the roll set 80 may sometimes be omitted.

The roll set 80 includes three fixed rolls 120, 121 and 122 and two opposed adjustable rolls 123 and 124 which are movable by adjusting screws 125 and 126, respectively. The rolls 123 and 124 are movable toward and away from the nest formed between the rolls 120, 121 and 122.

Roll set 81 includes fixed rolls 128 and 129 and movable rolls 130 and 131, the position of which is controlled by adjusting screws 132 and 133, respectively. The adjustable rolls in each set may be stub shaft rolls and the journals for such shafts may be movable by the adjusting screws. For the roll set 80 the adjusting screws and shaft journals are mounted in the plate 106. For the roll set 81, the adjusting screws and journals are mounted in block 134 secured to the face of the plate 106. Each of the rolls is profiled as indicated at 136 and the profile of the rolls is chosen in such a way that a complete range of rods may be straightened with the same rolls.

Figure 6:
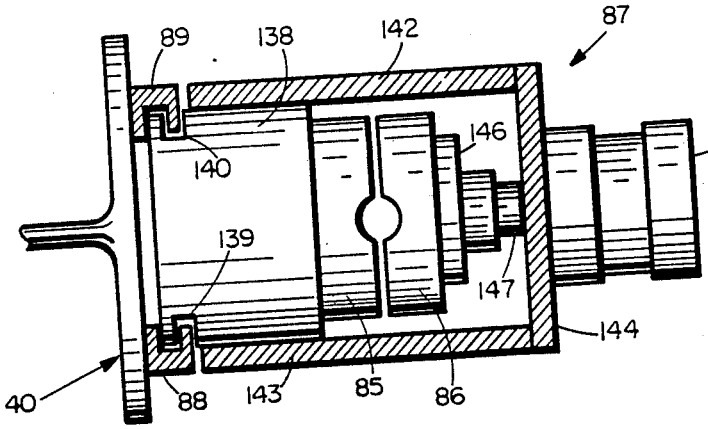
FIG. 6 is an enlarged horizontal section through the rod gripping jaws as seen from the line 6—6 of FIG. 1.

Referring now to FIG. 6 it will be seen that the vice or jaw assembly 87 includes a base 138 provided with grooves 139 and 140 which are confined by and slide in the gibs 88 and 89. Secured to the base are housing side plates 142 and 143 and an end plate 144 on which the piston-cylinder assemblies 92 and 93 are mounted. The end plate may readily be removed from the side plates. Jaw 85 is removably secured to the base 138 while jaw 86 is removably secured to plates 146 mounted on the ends of the rods 147 of the piston-cylinder assemblies 92 and 93. The vice jaws 85 and 86 are made from normal steel and have a smooth internal surface. For each diameter of rod it is preferred to use jaws which have the correct profile. This avoids damage to the copper cladding of the rod. The hydraulic pressure generated by the jaw clamping piston-cylinder assemblies 92 and 93 is preferably from about 150 to 180 bar. The pressure generated by the pushing piston-cylinder assembly 100 can be regulated between approximately 10 and 70 bar. In this manner the pressure generated by the piston-cylinder assembly 100 pushing the jaw assembly downwardly can be controlled to avoid slippage and the possibility of marring the cladding on the rod.

Figure 7:
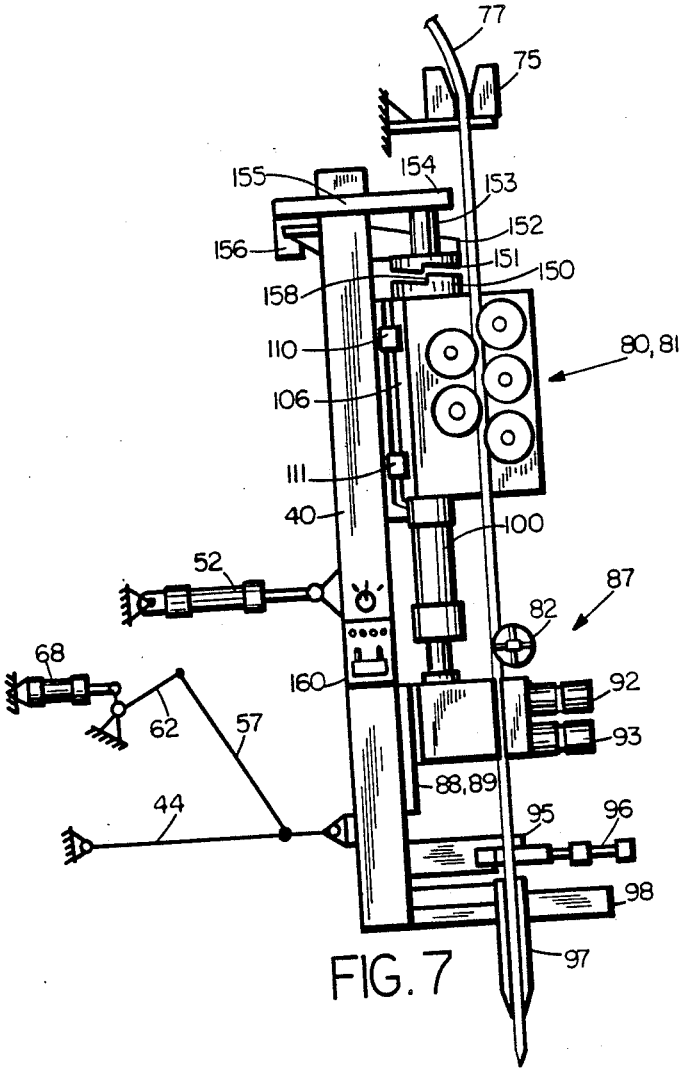
FIG. 7 is an enlarged somewhat schematic side elevation of the driver unit showing in more detail the mechanical vibration system.

Referring again to FIGS. 1 and 7, in case the rod meets soillayers which are difficult to penetrate, it will cause an increase in the driving-in resistance, and then, because of the higher reaction force on piston-cylinder assembly 100 the plate 105 at the blind end of such piston-cylinder assembly which is secured to the straightener plate 106 moves upwardly until the plate 105 contacts the bottom edge of fixed face plate 112. In such position, a fixed vibration ring 150 on the top of the plate 106 is brought into contact with a rotating vibration plate 151. The rotating vibration plate 151 is mounted on the underside of a fixed bracket or plate 152 extending from the frame 40 and is driven for rotation by a shaft 153 on which is mounted pulley 154. A belt or chain drive 155 is driven by motor 156. As indicated in FIG. 7, the facing vibration rings 150 and 151 are provided with inclined surfaces and steps seen at 158. In this manner when the vibration rings are in contact, the vibration system provides high frequency vertical impacts which vibrate vertically the entire system including the straighteners, the piston-cylinder assembly 100 and the jaws and thus the rod 77. This facilitates the driving of the rod through difficult to penetrate layers. The motor 156 may preferably be a hydraulic motor also driven from the hydraulic system. Such motor as well as the other hydraulic actuators will normally be controlled automatically but may also be controlled manually from control panel 160.

Figure 8:
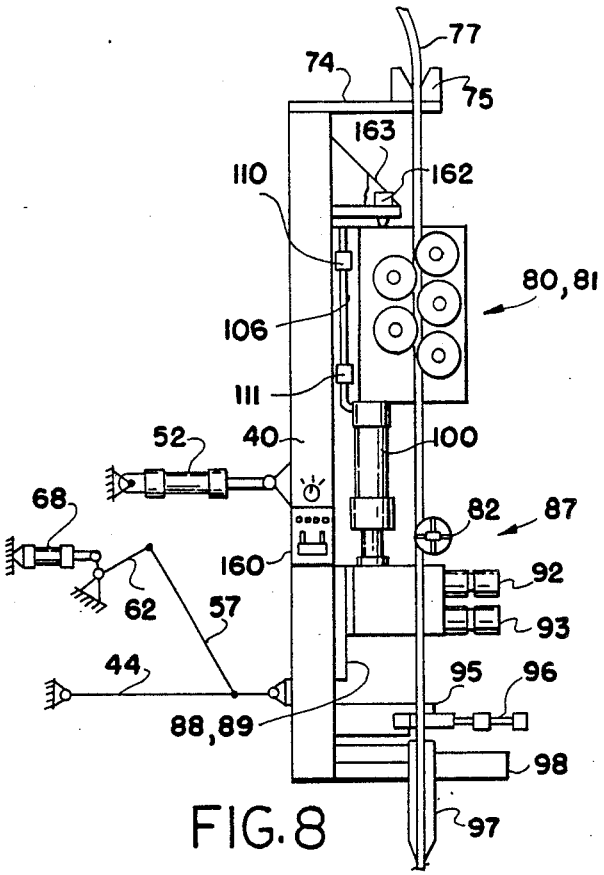
FIG. 8 is a view similar to FIG. 7 but showing the cylinder and straightener mounted for limited upward movement which actuates a sensor to commence hydraulic vibration.

Referring now to FIG. 8, instead of the mechanical vibrator the moving up of the straightener plate 106 by an increase of driving in resistance simply trips a switch 162 or other suitable sensor mounted on bracket 163 from the frame 40. The sensor 162 may then be used to bring into play a hydraulic vibration system such as those shown schematically in FIGS. 10–12. Thus, the cylinder of the assembly 100 together with the straighteners will move slightly upwardly as the driving in resistance increases.

Figure 9:
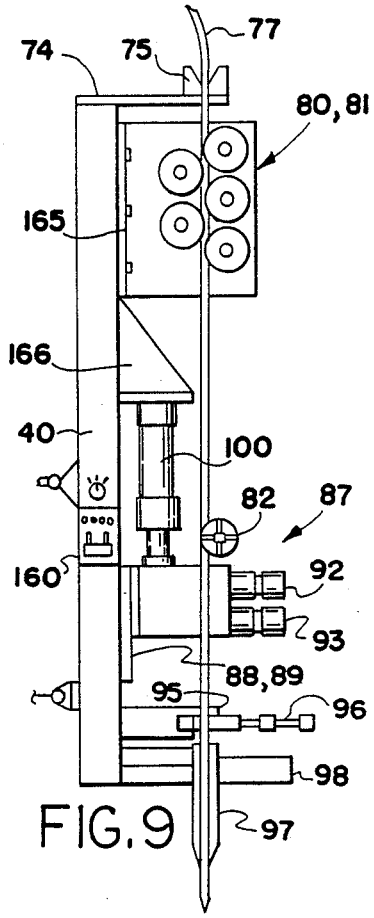
FIG. 9 is a view similar to FIGS. 7 and 8 but showing the cylinder fixed to the frame, with vibration if employed being obtained through the use of a pressure sensor.

In FIG. 9, the straighteners 80 and 81 are mounted on a plate 165 which is secured directly to the frame 40. Also, the blind end of the cylinder assembly 100 is supported by bracket 166 also secured to frame 40. The cylinder may, of course, be secured to the straighteners which are in turn secured to the frame but in either case both the cylinder and straighteners are fixed to the frame. In this embodiment a pressure sensor sensing the hydraulic pressure in the blind end of the cylinder assembly may bring into play the hydraulic vibration of the system upon the increase of driving in resistance.

Figure 10:
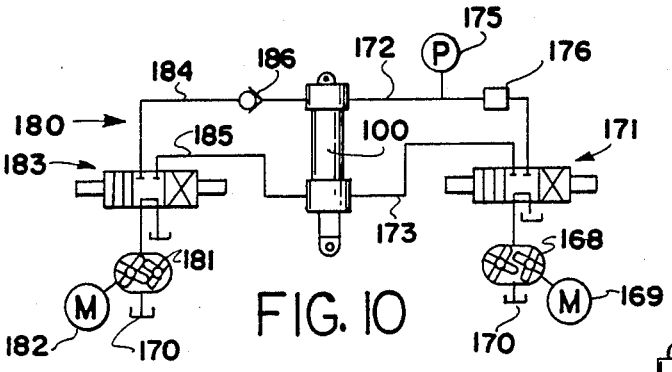
FIG. 10 is a hydraulic schematic illustrating the use of an auxiliary pulse creating circuit which may be used in conjunction with the main control hydraulics.

Referring now to FIG. 10 there is schematically illustrated a hydraulic vibration system using an auxiliary vibration pump system which may be used in conjunction with the main control hydraulics. The main control hydraulics include pump 168 driven by motor 169. The pump supplies hydraulic fluid from tank 170 to control valve 171 which, depending upon the position of the valve, directs fluid pressure to either line 172 or 173 connected to the blind and rod ends of the cylinder of the assembly 100, respectively, while connecting the other line back to the tank. The line 172 may also contain a pressure sensor 175 and a pressure regulating valve 176.

The auxiliary system is shown generally at 180 and includes a pump 181 driven by motor 182. The pump 180 is slightly altered to produce hydraulic pulses, the frequency of which is controlled by the speed of the motor and thus the pump. As illustrated schematically, both pumps 168 and 181 may be gear pumps but the pump 181 has a tooth or portion of a tooth of the idler gear removed. A multiple piston or vane pump can also be used with a piston or vane altered. The output of the pump is connected through control valve 183 to lines 184 and 185 with the former being connected to the blind end of cylinder assembly 100 through check valve 186. The vibration of the system may be brought into play by the shifting of the control valve 183 which may in turn be obtained by actuation of sensor 162 in FIG. 8 or by actuation of a pressure sensor 175 if the cylinder is fixed as in FIG. 9.

Figure 11:
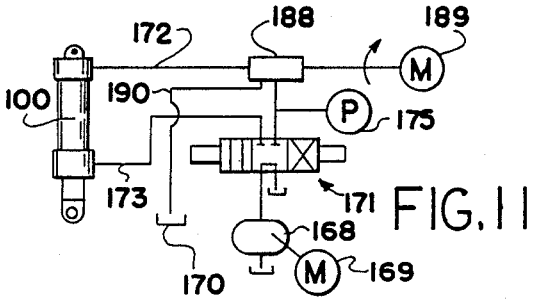
FIG. 11 is a hydraulic schematic illustrating the use of a rotary valve in the hydraulic circuit to obtain the desired vibration at a predetermined pressure or cylinder position; and, FIG. 12 is a similar schematic illustration the use of a shuttle valve for such purpose.

With reference to FIG. 11, hydraulic vibration may be obtained by a rotary valve 188 which is driven by motor 189. The rotary valve opens the pressure in line 172 through line 190 to tank upon rotation of the valve causing pressure pulses. The frequence of the vibration may be controlled by the speed of motor 189. Again, the motor and vibration system may be actuated by the pressure sensor 175 or the position sensor 162.

Figure 12:
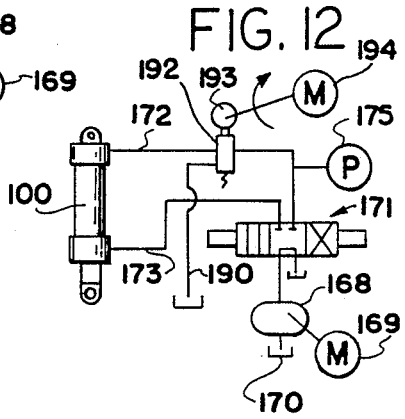

In FIG. 12, there is illustrated a similar circuit utilizing a reciprocating shuttle valve 192 to obtain hydraulic vibration. The shuttle of the valve as illustrated may be spring loaded and driven for reciprocation by cam 193 through motor 194, with the speed of rotation controlling the frequency. The shuttle may also be operated electrically.

The illustrations simply provide several ways of providing vibration and a variety of other commercially available hydraulic devices and circuits or mechanical systems may be provided for such purpose.

When starting the driving procedure the guide tube 97 is secured to the tube holder after which the driving unit is placed on the ground with the help of the lifting system, thus pressing the guide tube into the soil. In case the rod is to be driven at an angle other than vertical, that angle may be controlled by the piston-cylinder assembly 52.

The leading end of the rod is then moved from the spool 34 through the guide 75 and through the open straightening roll sets 80 and 81. The roll sets may then be adjusted. The rod leading end then moves downwardly to be gripped by the jaw assembly 87. Usually at this time the straightener will then be adjusted to final position.

After the hydraulic system is switched on, the vice will be closed automatically and the hydraulic piston-cylinder assembly will push the vice or jaw assembly downwardly a stroke length of approximately 2/10 of a meter. When the piston-cylinder assembly is extended and the jaw assembly 87 is in the bottom position, the vice will open automatically and the pistoncylinder assembly 100 will retract. When the jaw assembly is in the top position the jaw assembly again closes and extension again pushes the jaw assembly and the rod downwardly. This intermittent pushing of the rod continues automatically. During this operation the rod will pass through the guide tube 97 which may have a length of approximately one-half of a meter and which guides the rod into the top layer of the soil. The use of the guide tube is preferred because the top layer of the soil is usually quite weak and in this top layer it is possible for the rod to bend easily. The guide tube also provides a fixed driving direction into the soil and assists in keeping the rod straight.

As indicated, if the rod meets soil-layers which are difficult to penetrate, the upward pressure in the FIG. 7 embodiment raises the straightener block or plate 106 causing the vibration rings 150 and 151 to engage thus imparting high frequency impacts to the entire system including the rod. In the embodiment of FIGS. 8 and 9, the position sensor or the pressure sensor may bring into play the hydraulic vibration of the system.

After having the right length of the rod enter the soil, it is possible to cut the rod by using the shear 95 operated by hydraulic cylinder 96. The counting wheel 82 shows the length of the rod which is in the ground.

On some occasions, the cut-off rod may be required to not appear above the soil. In such a situation, the operator may cut the rod close to its final position and then continue driving the rod approximately one-half meter more into the soil. The guide tube is only approximately 2 mm larger than the diameter of the rod and accordingly the cut rod ends cannot be side by side within the guide tube.

Also, it is possible to pull the rod out of the soil and this can be done by simply reversing the operation. A reversing switch may be provided on the control panel 160 for this purpose.

As indicated the stroke length of the pushing hydraulic cylinder 100 is approximately 0.2 meters and includes a pressure area of its cylinder of approximately 33 $cm^2$ which provides a maximum push force of approximately 2.3 tons. The pulling area of the cylinder is approximately 23.5 $cm^2$ providing a maximum pull force of about 1.65 tons.

The material with which the present invention can be used is steel rod or wire, galvanized steel, stainless steel, copper or copper clad steel, aluminum or aluminum clad steel, and alloys of these materials.

The entire device as illustrated may be installed on a truck on which one spool is installed. The hydraulic pump system is mounted on the engine of the truck and has a pump capacity of approximately 40 liters per minute with 180 bar pressure. The crane on the truck may be used to change spools which may either be brought along on a trailer or on the bed of the truck.

Although a horizontal axis coil supply has been illustrated it will be appreciated that a vertical axis coil or spool may equally well be used.

With the present invention one-piece rods may readily be placed to a standard depth of 38 meters. In fact rods in excess of 70 meters have been properly placed with the present invention.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

We claim:

1. A ground rod driver comprising a frame, a coil supply of continuous ground rod feeding said driver, a jaw slide assembly mounted on said frame for movement toward and away from the ground, power means to move said assembly toward and away from the ground, and a power-operated releasable gripping jaw mounted on said slide assembly operative automatically to grip a ground rod when said slide is moved toward the ground, and release such ground rod when said slide is moved away from the ground, whereby such continuous ground rod may be pulled from said coil supply and driven incrementally into the ground.

2. A driver as set forth in claim 1 including straightening means for said rod between said coil supply and gripping jaw.

3. A driver as set forth in claim 2 wherein said straightening means comprises a roll set mounted on said frame.

4. A driver as set forth in claim 3 wherein said straightening means comprises two roll sets mounted on said frame, said respective roll sets being in planes normal to each other.

5. A driver as set forth in claim 1 including a guide tube at the bottom of said frame into which such rod is driven.

6. A driver as set forth in claim 5 including a rod shear above said guide tube and below said gripping jaw.

7. A driver as set forth in claim 1 including means to support said frame for angular adjustment with respect to the ground to control the angle at which the ground rod is driven into the ground.

8. A driver as set forth in claim 1 wherein said means to move said assembly comprises a piston-cylinder assembly.

9. A driver as set forth in claim 1 including a vehicle supporting both said driver and said coil supply, and means mounting said driver at the back of said vehicle for movement to and from an operative and a transportation position.

10. A driver as set forth in claim 9 including a hydraulic power unit on said vehicle operative to power said driver.

11. A driver as set forth in claim 1 wherein said releasable gripping jaw comprises a fixed jaw and a movable jaw, both of said jaws being elongated in the direction of the axis of the rod.

12. A driver as set forth in claim 11 including a pair of piston-cylinder assemblies operative to open and close said movable jaw.

13. A driver as set forth in claim 1 including means to vibrate said jaw slide assembly and thus said rod when the rod encounters increased driving in resistance.

14. A driver as set forth in claim 13 wherein said means to vibrate imparts high frequency vertical impacts to such rod.

15. A driver as set forth in claim 14 wherein said means to vibrate comprises a rotary vibration ring.

16. A driver as set forth in claim 13 including a hydraulic piston cylinder assembly operative to move said jaw slide assembly toward and away from the ground, said means to vibrate said jaw slide assembly comprising pulse generating means in the circuit of said hydraulic piston cylinder assembly.

17. A driver as set forth in claim 16 wherein said pulse generating means comprises a pump in an auxiliary hydraulic circuit.

18. A driver as set forth in claim 16 wherein said pulse generating means comprises a rotary valve in the circuit of said hydraulic piston cylinder assembly.

19. A driver as set forth in claim 16 wherein said pulse generating means comprises a shuttle valve in the circuit of said hydraulic piston cylinder assembly.

20. A driver as set forth in claim 1 wherein said means to move said assembly comprises a piston-cylinder assembly having a rod end and a blind end, said rod end being connected to said slide whereby pressure in the blind end of said piston-cylinder assembly drives the ground rod into the ground when said gripping jaw grips the ground rod.

21. A ground rod driver comprising a frame, a jaw slide assembly mounted on said frame for movement toward and away from the ground, means to move said assembly toward and away from the ground comprising a piston-cylinder assembly, a releasable gripping jaw mounted on said slide assembly operative to grip a ground rod when said slide is moved toward the ground, and release such ground rod when said slide is moved away from the ground, wherein the rod of said piston-cylinder assembly is connected to said slide assembly and the cylinder is mounted for short distance movement on said frame.

22. A driver as set forth in claim 21 including means to vibrate said driver and thus the driven rod when the cylinder moves such short distance.

23. A driver as set forth in claim 22 wherein said means to vibrate comprises a rotationally fixed and a rotary vibration ring which are brought into engagement when said cylinder moves such short distance.

24. A driver as set forth in claim 23 including a motor operative to drive said rotary vibration ring.

25. A driver as set forth in claim 22 including a rod straightener mounted on said frame for short distance movement above said cylinder, said cylinder being mounted on the lower end of said straightener, and means to vibrate said driver and thus said rod when said rod straightener moves through such short distance.

26. A driver as set forth in claim 25 including a fixed vibration ring on top of said straightener, and a rotary vibration ring spaced thereabove operative to engage said fixed ring when said straightener moves through such short distances.

* * * * *